United States Patent [19]

Kakuda

[11] Patent Number: 4,999,733

[45] Date of Patent: Mar. 12, 1991

[54] WEB ELECTRICITY REMOVING ROLLER

[75] Inventor: Tunenari Kakuda, Fujinomiya, Japan

[73] Assignee: Fuji Photo Film Co., Ltd., Tokyo, Japan

[21] Appl. No.: 343,562

[22] Filed: Apr. 27, 1989

[30] Foreign Application Priority Data

Apr. 28, 1988 [JP] Japan ..... 63-107207

[51] Int. Cl.[5] ..... H05F 3/06; H01T 23/00

[52] U.S. Cl. ..... 361/213; 361/221; 361/229; 361/214; 250/325

[58] Field of Search ..... 361/212–214, 361/220, 221, 229–231, 235; 250/324–326, 423 P; 355/221–227; 427/39; 118/651, 661

[56] References Cited

U.S. PATENT DOCUMENTS

| | | | |
|---|---|---|---|
| 900,830 | 10/1908 | Chapman | 361/230 |
| 3,254,215 | 5/1966 | Oliphant | 250/325 |
| 3,585,448 | 6/1971 | Simons | 361/230 |

*Primary Examiner*—A. D. Pellinen
*Assistant Examiner*—David Osborn
*Attorney, Agent, or Firm*—Sughrue, Mion, Zinn, Macpeak & Seas

[57] ABSTRACT

A web electricity removing roller which removes static charge appearing on the surface of a web formed of paper, a plastic sheet or the like. The roller has a rotary cylindrical body as the main body thereof for guiding contact with the web. The rotary cylindrical body can be electrically connected to a power source or grounded. A plurality of through bores are formed in the peripheral surface of the cylindrical body and a discharge electrode is disposed within the rotary cylindrical body. The electrically charged particles that are radiated from the discharge electrode by corona discharge form an electrically charged layer on the outer peripheral surface of the rotary cylindrical body which can remove the static charges from the surface of the web in surface contact with the roller.

8 Claims, 4 Drawing Sheets

WEB ELECTRICITY REMOVING ROLLER

BACKGROUND OF THE INVENTION

1. Field of the Invention

The present invention relates to a web electricity removing roller and, in particular, to a web electricity removing roller which removes the static electricity that appears on the surface of a web formed of paper, plastic sheet, or the like.

2. Description of the Related Art

Recently, in processes for manufacturing and machining webs which are formed of various kinds of plastics or the like, the web carrying speed has been increased to levels that have increased the possibility of static electricity. It is well known that static electricity gives rise to various kinds of obstacles in the respective processes for producing the webs. In other words, when the static electricity occurs in the web once, if the electric charges go over a predetermined value, then a spark discharge will be produced between the web and a carrying roller or other similar components. Occurrence of such discharge provides a very great problem. Especially, in steps of applying and drying an emulsion in manufacturing photo-sensitive materials, the webs may be defective due to such discharge.

In photographic paper or the like, there is included one which has a hydrophobic surface. That is, in the surface of the photographic paper, originally, a polymer film and a polymer are coated, so that the paper surface is hydrophobic. However, in order to be able to apply a photographic emulsion, especially, a gelatin silver halide emulsion, it is necessary to make the paper surface hydrophilic. For this reason, in the polymer-coated, photographic paper, a strong corona discharge is applied onto the surface of the paper to thereby activate the paper surface so that the surface has a hydrophilic nature.

However, after such corona discharge, static electric charges are present unevenly on the polymer surface. Because of this, it is impossible to coat the emulsion evenly. Therefore, it is necessary to remove the static electric charges from the surface of the photographic paper or to electrically charge the paper surface in an even manner before the emulsion is coated. This is why various kinds of electricity removing ways have been applied to such hydrophobic photographic paper and the like.

For example, there is disclosed by the present applicant an electricity removing method (Japanese Patent Application (Tokkai) No. 62-131500) of removing static electric charges from a web by guiding the web over an electricity removing roller which is formed by alternately combining a material to be positively chargeable by means of friction with respect to a charged web with a material to be negatively chargeable by means of such friction.

Also, the prior art electricity removing methods include: a method in which, in a route for carrying a support member before the emulsion is applied, there is provided a heating zone, where a blast of hot air is blown to the support member to heat the support member; a method in which there is provided an ultrared ray heating zone or a microwave heating oven, and a web is passed through such heating zone or oven so that the web can be heated radiatively or inductively; and, a method in which a carrying roller to be enageable with a web is heated electrically or by means of a blast of hot air or steam (see, Japanese Patent Application (Tokkai) No. 54-54020).

In addition, there is disclosed a method of removing electric charges from a film, in which negative and positive ions are generated from a corona-discharge-type electricity removing device using corona discharge.

Referring now to FIG. 6, there is shown an apparatus for removing corona discharge on the surface of a photographic paper by use of electrode rollers which are disclosed in Japanese Patent Publication (Tokkou) No. 49-37841. As shown in FIG. 6, a web 50, on which a corona discharge processing or an electricity removing processing is performed, is supplied from a roll 52. The web 50 is moved to an electrode roller 54, rollers 56, 58, an electrode roller 60 and discharge roller 62, sequentially in this order, that is, the web 50 is carried at a high speed between them for the above-mentioned processing.

The electrode roller 54 has a main body 55 which is formed of an electrically conductive material, and also has a rotational shaft 64 which is grounded. Upwardly of the electrode roller 54, there is provided a discharge electrode 68 which is connected to power supply source 66. In such structure, corona discharge can occur between the discharge electrode 68 and the electrode roller 54. The downstream electrode roller 60 has a main body 61 which is formed of an electrically conductive material and also has a rotational shaft 69 which is connected to another power supply source 71 in such a manner that a voltage of 500 to 50,000 volts can be applied.

Downwardly of the electrode roller 60, there is disposed a knife-shaped electrode 73 which is grounded. Due to this, a given voltage can be applied between the electrode roller 60 and the knife-shaped electrode 73.

In the above-mentioned structure, the web 50 is moved to and over the electrode rollers 54 and 60 at the speed of 15 to 180 m/min. (50 to 600 fpm) or greater before it is discharged. When the web 50 is moved to the electrode roller 54, the surface of the web 50 is processed by means of corona discharge, that is, the web surface is activated so that it becomes hydrophilic.

Also, when the web 50 is moved to the electrode roller 60, the uneven static charges on the surface thereof are processed so that the static charges are modified into an even state.

However, in the above-mentioned electricity removing methods by use of corona discharge, the voltage can be applied only between the knife-shaped electrode 73 and the electrode 60 and thus the time for neutralizing the web is limited. For this reason, if the delivering speed of the web 50 is increased, then the amount of ions supplied by means of the corona discharge will come short so that the static charges cannot be removed from the web surface in a satisfactory manner.

SUMMARY OF THE INVENTION

The present invention aims at eliminating the drawbacks found in the above-mentioned prior art methods.

Accordingly, it is an object of the invention to provide a web electricity removing roller which is capable of surely removing static charges from the surface of a web even when the web is carried at a high speed.

In order to attain the above object, according to the invention, there is provided an electric removing roller having an outer peripheral surface of guiding contact with a web, the roller comprising: a rotatable cylindrical body which serves as an electrode and can be connected to a power source or grounded; and, a discharge electrode which is inserted into the cylindrical body to radiate particles charged by corona discharge toward the cylindrical body, characterized in that the inner peripheral surface of the cylindrical body is formed of an insulating material, and that in the cylindrical body there are formed a plurality of through bores for discharging the charged particles to the outer peripheral surface of the cylindrical body.

According to a web electricity removing roller of the invention, the charged particles due to corona discharge from the discharge electrode are discharged radially within the cylindrical body, are not taken into the inner peripheral surface of the cylindrical body formed of an insulating material, but are discharged through a plurality of through bores formed in the cylindrical body onto the outer peripheral surface of the cylindrical body. Due to this, a web, which is moved in guiding contact with such roller, can be electrically treated, that is, the static charges of the web can be removed from the surface thereof by the charged particles discharged in the above-mentioned manner.

Also, according to the invention, since an electrically charged layer is formed over the whole outer peripheral surface of the cylindrical body in a saturated state, the time for removing the static charges of the web is longer than in the prior art rollers. In addition, according to the present roller, the time for controlling the static charges of the web can be varied according to the amount of winding of the web onto the cylindrical body, that is, the length of the web's contact with the outer peripheral surface of the cylindrical body. Therefore, when the web is delivered at a high speed, by increasing the contact length between the web and the cylindrical body, the static charges on the surface of the web can be removed for sure.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE INVENTION

Detailed description will hereunder be given of the preferred embodiments of a roller for removing the static charges of a web according to the present invention with reference to the accompanying drawings.

Figure 1:
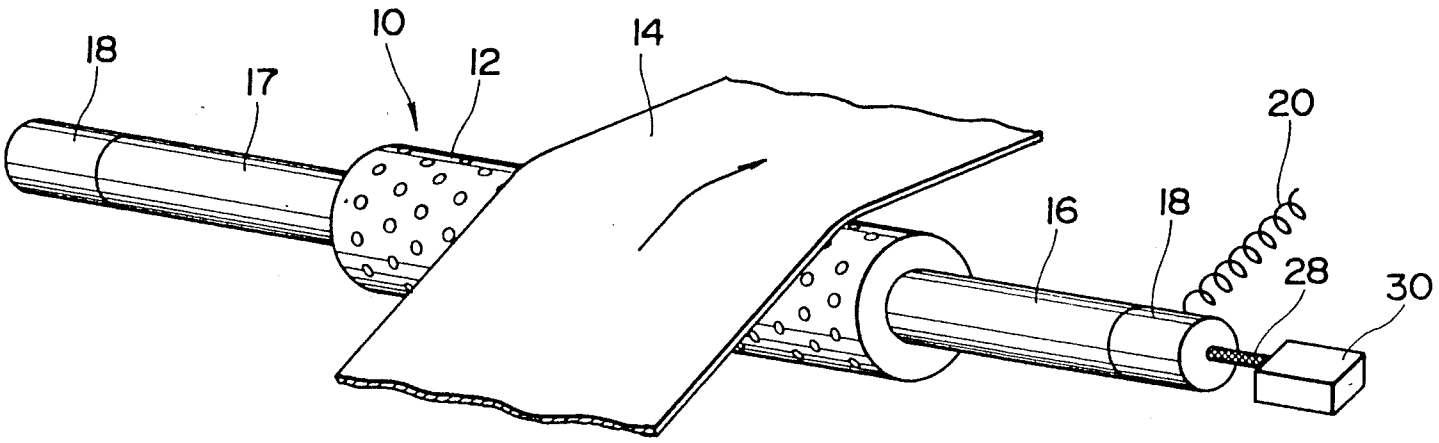
FIG. 1 is a perspective view of a web electricity removing roller according to the invention.
Figure 6:
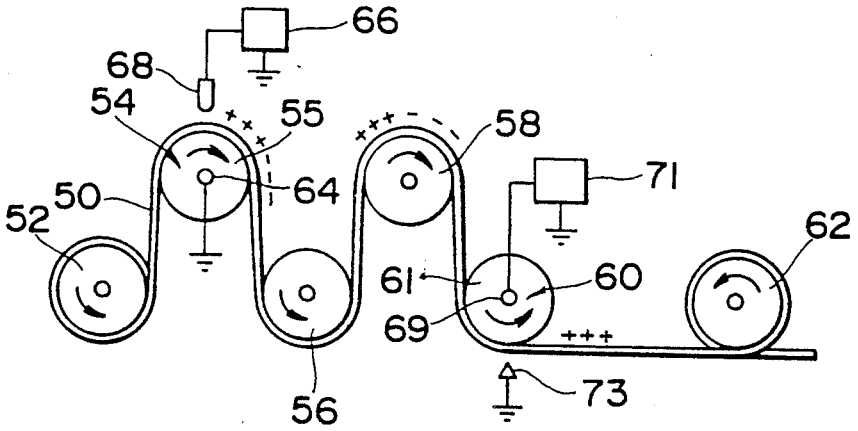
FIG. 6 (PRIOR ART)

A web electricity removing roller 10, which is shown in FIG. 1, according to the invention is disposed at the position of the electrode roller 60 shown in FIG. 6.

Figure 2:
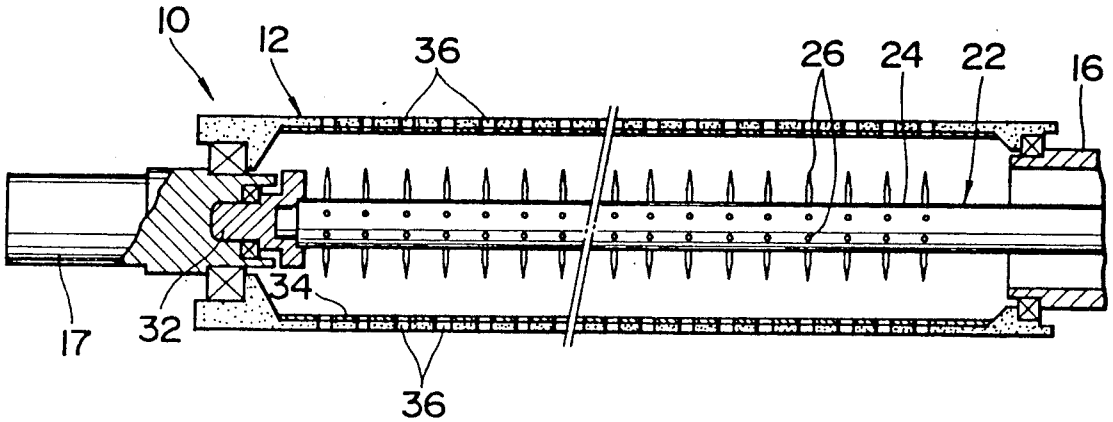
FIG. 2 is a side section view of a web electricity removing roller according to the invention.

The web electricity removing roller 10 shown in FIGS. 1 and 2 comprises a roller main body 12 which is formed in a cylinder-shape and a web 14 is brought into guiding contact with the outer peripheral surface of the roller body 12 at a high speed. The roller main body 12 is formed of an electrically conductive material and is supported at the two ends thereof by rotary shafts 16 and 17, while the rotary shafts 16 and 17 are supported by bearings 18 and 19, respectively, in such a manner that the shafts can rotated. An electric wire 20, which is to be grounded, is connected to the bearing 18 and the roller main body 12 is grounded by means of the rotary shaft 16, bearing 18 and electric wire 20 so that the roller main body 12 can serve as an electrode.

As shown in FIG. 2, the rotary shaft 16 is formed of a cylinder-shaped material and a discharge electrode 22 is inserted into the rotary shaft 16 and roller main body 12. The discharge electrode 22 includes a bar member 24 and a plurality of discharge needles 26, 26, . . . which are respectively disposed on and projected from the outer peripheral surface of the bar member 24.

The bar member 24 is formed of an epoxy material containing glass and is connected to a transformer 30 through a cable 28 which is shown in FIG. 1. Also, the leading end of the bar member 24 is connected through a cap 32 to the shaft 17. The bar member 24 may be fixed to the cap or the like, or may be rotatable.

The discharge needle 26 is formed of a tungsten material and is radially directed toward the inner peripheral surface of the roller main body 12. The length of the discharge needle 26 is preferably in the range of 3 to 25 mm, and a preferred distance between the discharge needle 26 and the inner peripheral surface of the roller main body 12 is in the range of 3 to 30 mm.

Also, the thickness of the roller main body 12 may be as small as possible, generally in the range of 1 to 6 mm. On the inner peripheral surface of the roller main body 12 there is formed an insulating polycarbonate film 34. Alternatively, the polycarbonate film 34 may be provided in such a manner that a polycarbonate material is previously formed into a pipe-like shape which corresponds to the inner peripheral diameter of the roller main body 12 and then the pipe-shaped member is disposed closely onto the inner peripheral surface of the roller main body 12. Further, in the roller main body 12, there are formed a plurality of circular through bores 36, 36, . . . in such a manner that they are arranged uniformly. The charged particles that are discharged from the discharge needles 26, 26, . . . can pass through the through bores 36, 36, . . . . Each of the through bores, preferably, has an opening percentage of 5 to 50%. Alternatively, the through bore 36 may be formed such that it is opposed to the discharge needle 26 of the discharge electrode 22.

Figure 3:
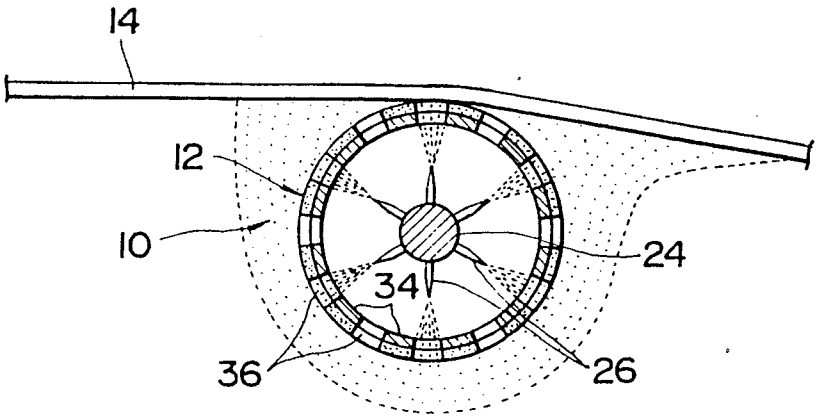
FIG. 3 is an explanatory view to show how to remove the static charges of a web by use of a web electricity removing roller according to the invention.

According to the web electricity removing roller constructed in the above-mentioned manner, the web 14 is brought into guiding contact with the roller main body 12 at a high speed. Also, when the web 14 is brought into guiding contact with the roller main body 12, a high voltage is applied to the discharge electrode 22 within the roller main body 12 through the transformer 30. As a result of such high voltage application, the charged particles due to corona discharge are discharged radially from the discharge needles 26 toward the roller main body 12. Without being absorbed into the polycarbonate film 34 on the inner peripheral surface of the roller main body 12 serving as an earth electrode, the charged particles are allowed to pass through the through bores 36, 36, . . . 296 and are then discharged onto the outer peripheral surface of the roller main body 12, as shown in FIG. 3. The discharged, charged particles form a charge layer on the outer peripheral surface of the roller main body 12. Accordingly, the static charges on the surface of the web 14, which is in guiding contact with the roller 10, can be removed by the charged layer on the outer peripheral surface of the roller main body 12 before the web 14 is sent out.

In this case, due to the fact that on the entire outer peripheral surface of the roller main body 12 there is formed in a saturated state the charged layer owing to the discharge electrode 22 disposed within the roller main body 12, the time for the static charges on the surface of the web 14 to be removed is extended. Also, the electricity removing time can be determined by the amount of contact surface of the web 14 around the roller main body 12, that is, the length of contact of the web 14 with the outer peripheral surface of the roller main body 12 and thus, when the web 14 is delivered at a high speed, it is possible to make sure that the static charges on the surface of the web 14 are removed by increasing the amount of contact surface of the web 14 with the roller main body 12.

In contrast with the present invention, in the prior art apparatus, a discharge electrode is disposed externally of an electrode roller and an electrically charged layer is formed on the outer peripheral surface of a portion of the electrode roller, so that only a short time is available for controlling the static charges on the surface of a web and also that it is not possible to change the charges controlling time according to the amount of contact surface of the web around the roller.

In the above-mentioned embodiment of the invention, the particles that are electrically charged due to the corona discharge by the discharge needles 26 may be positive or negative.

Figure 4:
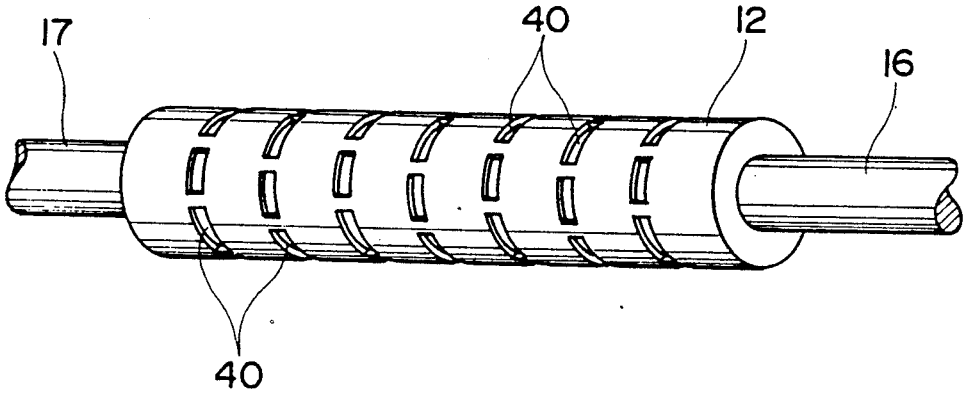
FIGS. 4 and 5 are respectively perspective views of modifications of a web electricity removing roller according to the invention; and, FIG. 6 is an explanatory view to show how to remove the static charges according to the prior art method.
Figure 5:
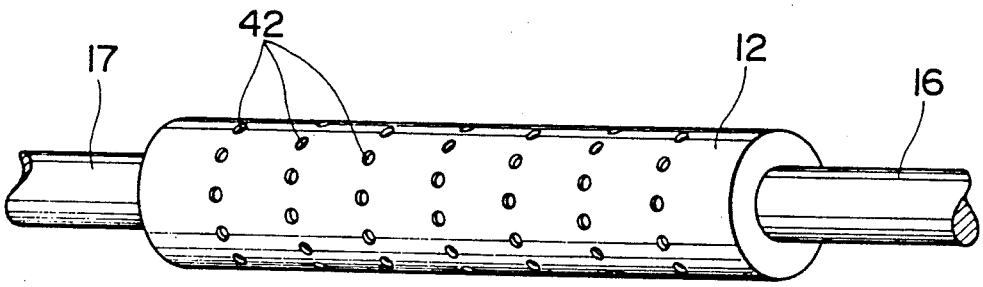

In the above-mentioned embodiment, the through bores 36 each having a circular shape are formed in the roller main body 12, but the invention is not limited to this. For example, as shown in FIG. 4, a plurality of elongated bores 40, 40, . . . may be formed in the main body 12 of the roller electrode 10. Also, they may be openings each of which is formed in a slit-like shape. Further, as shown in FIG. 5, the through bores 42, 42, . . . in the roller main body 12 may be formed in an elliptical shape. All of the above-mentioned provide sufficient effects similarly to the circular shape.

Next, description will be given below of an experiment in which the static charges on the surface of a web were removed actually by using a web electricity removing roller according to the invention. The opening ratio of the total peripheral surface of the roller main body 12 was 13%, the roller main body 12 was grounded, the thickness of the peripheral surface of the roller main body was 3 mm. Also, each of the discharge needles 26 of the discharge electrode 22 was 12 mm long and the distance between the discharge needle 26 and the cylinder-shaped roller main body 12 was 8 mm. Corona discharge was performed under the above-mentioned conditions.

As the web 14, there was used an easily chargeable plastic sheet which has a surface resistance of log SR value of $10^{-14}$ to $10^{-15}$, the charged plastic sheet was delivered at the speed of 10 to 200 m/min.

As a result of this, there were found static charge of ±100 volts on the surface of the plastic sheet but the charges were maintained in an even state. On the other hand, when a corona discharge type of electricity removing device according to the prior art was used, static charged of −12 to +25 KV were found on the surface of the plastic sheet, which are several hundreds times greater than those appearing in the web electricity removing roller according to the invention.

As has been described hereinbefore, according to the web electricity removing roller of the invention, the discharge electrode is disposed within the cylinder-shaped roller main body to thereby from the electrically charged layer on the outer peripheral surface of the cylinder-shaped roller main body and, for this reason, even when the web in surface contact with the roller is delivered at a high speed, the charged layer is formed in a saturated state on the peripheral surface of the cylinder-shaped roller, so that the static charges on the surface of the web can be removed for sure regardless of the travelling speed of the web.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A web electricity removing roller comprising:

a rotary cylindrical body having an outer peripheral surface for guiding contact with a web and being electrically connectable with a ground;

a discharge electrode inserted into said cylindrical body for radiating charged particles by corona discharge toward said cylindrical body;

said cylindrical body having an inner peripheral surface formed of an insulating material; and a plurality of through bores, in said cylindrical body, for discharging said charged particles to said outer peripheral surface of said cylindrical body.

2. A web electricity removing roller as set forth in claim 1, wherein said through bores are circular bores or elongated bores.

3. A web electricity removing roller as set forth in claim 2, wherein said discharge electrode comprises a bar member disposed within and coaxially with said cylindrical body and a plurality of discharge needles provided on and projected from the outer peripheral surface of said bar member.

4. A web electricity removing roller as set forth in claim 3, wherein said discharge needles are arranged radially toward the inner peripheral surface of said rotary cylindrical body.

5. A web electricity removing roller as set forth in claim 4, wherein said bar member is formed of a glass-containing epoxy material.

6. A web electricity removing roller as set forth in claim 5, wherein said discharge needles are respectively formed of a tungsten material.

7. A web electricity removing roller as set forth in claim 1, wherein said insulating material is a polycarbonate film.

8. A web electricity removing roller as set forth in claim 7, wherein said insulating material is formed by closely attaching a pipe-shaped polycarbonate film to the inner peripheral surface of said rotary cylindrical body.

* * * * *